US005862663A

United States Patent [19]

Lanza et al.

[11] Patent Number: 5,862,663

[45] Date of Patent: Jan. 26, 1999

[54] SYSTEM FOR RAISING AND LOWERING THE LOAD SUPPORT OF AN ELECTRIC LIFT TRUCK

[75] Inventors: Fabrizio Lanza, Milan; Sante Parente, Mola Di Bari-Bari, both of Italy

[73] Assignee: Fiat OM Carelli Elevatori S.A., Milan, Italy

[21] Appl. No.: 822,018

[22] Filed: Mar. 24, 1997

[30] Foreign Application Priority Data

Apr. 19, 1996 [IT] Italy ..... MI96A 0767

[51] Int. Cl.[6] ..... B66F 9/20

[52] U.S. Cl. ..... 60/432; 60/431; 60/477

[58] Field of Search ..... 60/431, 432, 477

[56] References Cited

U.S. PATENT DOCUMENTS

| | | | |
|---|---|---|---|
| 4,723,107 | 2/1988 | Schmid | 322/35 |
| 5,097,857 | 3/1992 | Mayhew | 137/1 |
| 5,505,043 | 4/1996 | Baginski et al. | 60/477 |
| 5,638,387 | 6/1997 | Palleggi et al. | 318/67 |
| 5,647,208 | 7/1997 | Spitzbarth | 60/431 |
| 5,649,422 | 7/1997 | Baginski et al. | 60/431 |

FOREIGN PATENT DOCUMENTS

0664273A1 7/1995 European Pat. Off. .

*Primary Examiner*—Sheldon J. Richter
*Attorney, Agent, or Firm*—Sheridan Ross P.C.

[57] ABSTRACT

In an electric lift truck, an asynchronous electric motor, a reversible sealed pump driven by the motor, communicating with the hydraulic actuators and also with a reservoir, a device which measures the angular position and the angular velocity of the motor, and a control and monitoring unit which causes the motor to be supplied according to the required speed of raising and lowering of the load support and on the basis of data supplied by the measuring device are used for raising and lowering the load support by means of one or more hydraulic actuators. There is a saving of energy in raising; there is also a recovery of energy in lowering, in which the motor acts as a generator to recharge the accumulator batteries of the lift truck.

10 Claims, 2 Drawing Sheets

SYSTEM FOR RAISING AND LOWERING THE LOAD SUPPORT OF AN ELECTRIC LIFT TRUCK

BACKGROUND OF THE INVENTION

The present invention relates to a system for raising and lowering the load support of an electric lift truck.

In an electric lift truck, the load is lifted by an electric motor which drives a pump which sends pressurized fluid through a hydraulic circuit to one or more hydraulic jacks which raise the support, for example forks, on which the load rests.

Normally, the electric motor which drives the pump is operated at two speeds only, namely a normal speed and a high speed, and the task of fine adjustment of the speed of rise of the forks is carried out by a hydraulic distributor which divides the flow of pressurized fluid sent to the hydraulic jacks. The operator moves a suitable control lever through which one of the two speeds of the motor is engaged and the distributor is operated: the position of the control lever corresponds to the required speed of rise.

The division of the flow of pressurized fluid results in the generation of heat and consequently the dissipation of energy. Evidently, a dissipation of energy results in a decrease in the duration of the charged state of the electrical accumulators of the truck and consequently a decrease in the operating range of the truck.

To lower the load, the control lever is moved in the opposite direction to the previous direction, and the distributor connects the fluid sent to the hydraulic jacks to a discharge system in such a way as to allow the forks to descend by gravity.

In lowering, therefore, there is a wastage of kinetic energy, which it would be very useful to recover.

SUMMARY OF THE INVENTION

The object of the present invention is to propose a system for raising and lowering the load support of an electric lift truck which makes it possible to eliminate the dissipation and wastage of energy which occur in known trucks.

This object is achieved by means of a system for raising and lowering the load support of an electric lift truck, comprising an electric motor supplied from a rechargeable source of electrical energy, a pump driven by the electric motor and communicating with a reservoir containing hydraulic fluid, and one or more hydraulic actuators supplied with the hydraulic fluid by the pump and connected to the load support for the upward and downward movement of the said support, characterized in that the electric motor is asynchronous, the pump is a reversible sealed pump, means of measuring the angular position and angular velocity of the asynchronous motor are provided, and an electronic control and monitoring unit is provided to control the supply to the asynchronous motor according to the required speed of raising and lowering of the load support and on the basis of supplied data by the measuring means, the asynchronous motor acting as a generator to recharge the electrical energy source when the load support is lowered.

BRIEF DESCRIPTION OF THE DRAWINGS

For a more detailed explanation of the invention, a description of one of its embodiments is provided by way of example, illustrated in the attached drawings in which.

DETAILED DESCRIPTION OF THE PREFERRED EMBODIMENT

Figure 1:
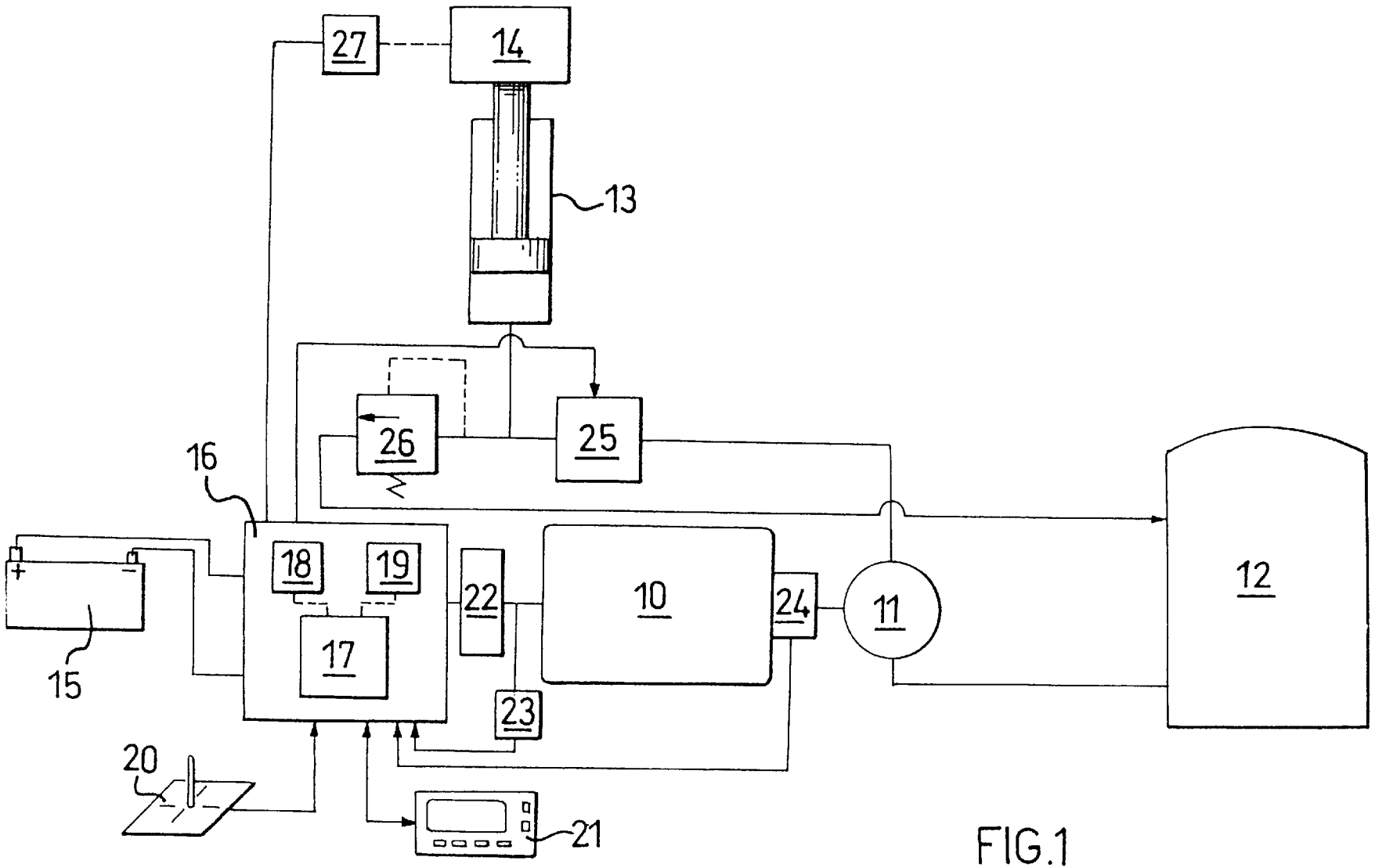
FIG. 1 shows schematically a system of raising and lowering the load support of a lift truck according to the invention.

The system shown in FIG. 1 comprises a three-phase asynchronous electric motor 10, preferably sealed and having a squirrel-cage rotor, a reversible sealed pump 11 driven by the motor 10 and communicating with a reservoir 12 containing oil, a hydraulic jack 13 connected to the pump 11, and a load support, shown schematically as a block 14, connected to the hydraulic jack 13. This load support may be a fork, a platform or other support on which the load to be raised or lowered rests.

The motor 10 is supplied from accumulator batteries 15 through an electronic microprocessor unit for control and monitoring, indicated by the number 16. This unit 16 comprises a microprocessor 17 connected to a memory 18 of the EPROM or equivalent type, which stores the program which the microprocessor executes and the data which the microprocessor processes, and a memory 19 of the EPROM or equivalent type, in which the microprocessor writes data and from which it reads data.

A lever controller 20 is connected to the input of the control and monitoring unit 16.

The unit 16 is also connected by a two-way link to a control and monitoring instrument 21 comprising a display, some indicator lamps and a keyboard.

The output of the unit 16 is connected to a power stage 22 of the type with a three-phase bridge of electronic switches, and in particular of MOSFETs, for the supply of the asynchronous motor 10.

The current supplied to the motor 10 is measured by a sensor unit 23, using the Hall effect for example, which sends the corresponding control signal through a feedback loop to the unit 16.

An optical angular encoder 24 is mounted on the motor 10 integrally with the motor shaft, and measures both the angular position and the angular velocity of the motor shaft and sends a corresponding electrical signal. This electrical signal is sent through a feedback loop to the unit 16.

A solenoid-operated valve 25 connected to, and controlled by, the unit 16 is located in the branch of the hydraulic circuit between the pump 11 and the jack 13.

A maximum-pressure valve 26 is also provided to discharge the oil into the reservoir 12 in the event of excess pressure in the hydraulic circuit.

Figure 2:
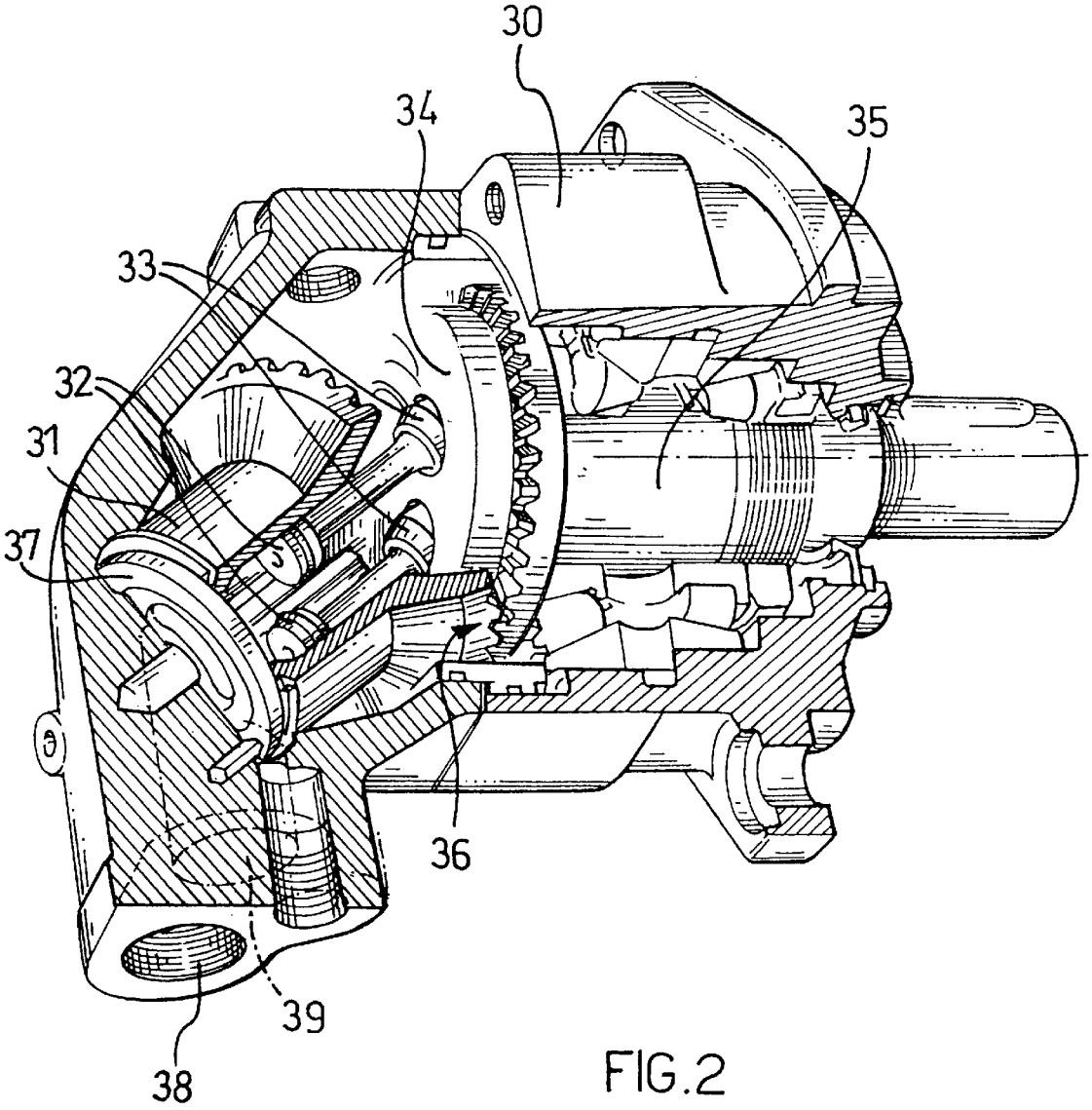
FIG. 2 shows in detail one component of the system shown in FIG. 1.

Preferably, the reversible sealed pump 11 is a multi-cylinder pump with axial pistons, such as that shown in FIG. 2. It comprises a stator body 30, and a rotor unit 31 in which pistons 32 parallel to each other are housed slidably. The pistons 32 are connected by corresponding ball joints 33 to a plate 34 integral with a shaft 35 which is driven by the asynchronous motor 10; the axis of the rotor unit 31 is inclined with respect to the axis of the plate 34 and of the shaft 35. The shaft 35 is also connected by a gear coupling 36 to the rotor unit 31 so that it rotates with it. Against the rotating end of the rotor unit 31, at the outlets of the cylinders in which the pistons 32 slide, is located a fixed distributor 37 in which two ports are formed, one for inlet and one for delivery (only one of these is visible in the figure), the first communicating with an inlet duct 38 and the second with a delivery duct 39. As the rotor unit 31 rotates, the pistons 32 move with a reciprocating motion, and according to their angular position draw oil from the inlet duct 38 through the inlet port of the distributor 37 or send oil to the delivery duct 39 through the delivery port of the distributor.

The system described and illustrated works in the following way.

If the load support 14 is to be raised, the operator moves the lever controller 20 correspondingly, and consequently the control and monitoring unit 16, according to the signals fed back to it from the sensor unit 23 and from the encoder 24, regulates the power stage 22, connected to the accumulator batteries 15, so that it supplies the asynchronous motor 10 which drives the pump 11, which in turn sends pressurized oil to the jack 13, causing the raising of the load support 14. In particular, the microprocessor 17 of the unit 16 supplies to the motor 10, by means of the power stage 22, a three-phase alternating current having values of intensity and frequency suitable for obtaining the required raising speed, using, for calculation and control purposes, the current values supplied by the sensor unit 23 and the angular position and angular velocity data supplied by the encoder 24. In this way it is possible optimally to control what is known as the slip of the asynchronous motor 10 and to obtain a value of maximum torque of the motor for each required value of raising speed.

If the load support 14 is to be lowered, the operator moves the lever controller 20 in a corresponding way, and the unit 16 supplies the motor 10 in an appropriate manner, again by means of the sensor unit 23 and the encoder 24, in such a way that the fluid pressure due to the load, and acting on the pump 11 through the hydraulic jack 13, is greater than the torque supplied to the pump by the motor, so that the pump rotates in the reverse direction and the load support 14 descends at the required speed. In these circumstances, the electric motor acts as an electrical generator and supplies electrical energy to the accumulator batteries 15, thus recharging them.

If the load support 14 is to be halted in a predetermined position, the unit 16 supplies the motor 10 in such a way that the torque supplied to the pump 11 is such as to balance the oil pressure due to the load and acting on the pump. After a brief period, to avoid electrical energy being wasted, the unit 16 operates the solenoid-operated valve 25 which cuts off the communication between the jack 13 and the pump 11 and stops the supply to the motor; the oil is no longer able to flow from the jack to the pump, and the load support 14 remains in position.

The display and the indicator lamps of the instrument 21 show operating conditions and parameters, and also alarm situations. By means of the keyboard and display, and owing to their interaction with the unit 16, and in particular with the microprocessor 17 and the read/write memory 19, it is possible to set and change the system operating parameters, for example the acceleration and deceleration to be imparted to the load support 14 in raising and lowering, or to set the halting of the load support in a predetermined position.

Also provided is a sensor 27 which senses when the load support is stopped by external causes during its descent and sends a corresponding signal to the unit 16 in such a way that this unit immediately stops the motor 10. If the load support is moved by chains acting on a link rod, it is possible to use a proximity sensor which detects the anomalous position of the link rod in the stop situation described above.

The system described enables energy to be saved in the raising of the load support and enables energy to be recovered in the lowering of the load support.

In raising, the unit 16 only supplies to the asynchronous motor 10 the energy necessary to provide the required raising speed, by contrast with the known art in which there are only two motor speeds and the flow of the hydraulic fluid is divided, thus dissipating energy.

In lowering, the pump 11, being of the reversible sealed type, can, by means of the asynchronous motor and under the control of the unit 16, convert the kinetic energy of the descent of the load support to electrical energy for the recharging of the accumulator batteries, in such a way that energy is recovered, by contrast with the known art in which the oil is discharged and the kinetic energy of descent is wasted.

The multi-cylinder pump with axial pistons is particularly effective owing to its complete reversibility and its optimal operation at all speeds, in other words from zero to maximum speed.

In certain lift trucks, the pump may also supply pressurized oil to hydraulic circuits for devices for the inclination and lateral movement of the load support and also to hydraulic circuits for power steering with or without hydraulic accumulators. In this case also, there is a considerable saving of energy, due to the fact that the motor rotates the pump at a speed exactly corresponding to the capacity which is used, whereas in the conventional system the speed never falls below a certain number of revolutions. With respect to power steering with an accumulator, the system is highly efficient in that the motor runs only for the brief period necessary to recharge the accumulator.

Among other advantages, the ability to operate at a low number of revolutions makes it possible to have a truck with low noise and also to keep the oil temperature low, so that the seals of the circuits and of the hydraulic components are less subject to wear.

Obviously, variations on and/or additions to the system described and illustrated are possible.

The load support may have any configuration and may be operated by more than one hydraulic jack. Hydraulic actuators of any type may be used in place of the hydraulic jacks.

Variants of the control and monitoring system may be provided, and in particular memories of different types but with equivalent functions may be used in the control and monitoring unit, and current sensors of different types may be provided.

The means of measuring the angular position and angular speed of the asynchronous motor may also be magnetic encoders or means of other types.

Any type of multi-cylinder pump may be used as the pump. A different type of pump may also be provided, as long as it is reversible and sealed.

In the lift truck, the control and monitoring system, together with the instrument which includes the display, the indicator lamps and the keyboard, may operate the electrical traction system of the lift truck as well as the raising and lowering system.

What is claimed is:

1. System for raising and lowering the load support of an electric lift truck, comprising an electric motor supplied from a rechargeable source of electrical energy, a pump driven by the electric motor and communicating with a reservoir containing hydraulic fluid, and one or more hydraulic actuators supplied with the hydraulic fluid by the pump and connected to the load support for the upward and downward movement of the said support, characterized in that the electric motor is asynchronous, the pump is a reversible sealed pump, means of measuring the angular position and angular velocity of the asynchronous motor are provided, and an electronic control and monitoring unit is provided to control the supply to the asynchronous motor according to the required speed of raising and lowering of the load support and on the basis of data supplied by the measuring means, the asynchronous motor acting as a generator to recharge the electrical energy source when the load support is lowered.

2. System according to claim 1, in which the pump is a multi-cylinder pump.

3. System according to claim 2, in which the pump is a multi-cylinder pump with axial pistons.

4. System according to claim 1, in which the said measuring means consist of an encoder mounted on the shaft of the asynchronous motor.

5. System according to claim 1, in which the control and monitoring unit has its input connected to a lever controller.

6. System according to claim 1, in which the control and monitoring unit is connected by a two-way link to an instrument comprising a display and a set of indicator lamps for the display of operating conditions and parameters of the system and of alarm situations, and comprising keys for setting and changing the operating parameters displayed.

7. System according to claim 6, in which the control and monitoring unit comprises a microprocessor, a first memory which contains the programs which the microprocessor executes and the data which the microprocessor processes and a second memory in which the microprocessor writes data and from which it reads data.

8. System according to claim 1, in which there is provided a solenoid-operated valve located in the hydraulic circuit between the pump and the hydraulic actuators and connected to the control and monitoring unit, the said solenoid-operated valve being activated by the said unit to cut off the hydraulic communication between the pump and the hydraulic actuators after a predetermined period of time if a command is sent to stop the load support.

9. System according to claim 1, in which there is provided a sensor, connected to the control and monitoring unit, which senses when the load support is stopped by external causes during its descent and sends a corresponding signal to the unit for the immediate stopping of the motor.

10. System according to claim 1, in which the pump also supplies pressurized oil to hydraulic circuits for devices for the inclination and lateral movement of the load support and also to hydraulic circuits for power steering with or without hydraulic accumulators.

* * * * *

UNITED STATES PATENT AND TRADEMARK OFFICE

CERTIFICATE OF CORRECTION

PATENT NO. : 5,862,663

DATED : January 26, 1999

INVENTOR(S) : Lanza et al.

It is certified that error appears in the above-indentified patent and that said Letters Patent is hereby corrected as shown below:

On the title page:

Item: [75] please delete the word "Bari-Bari" and insert --Bari --.

Item: [73], please delete the word "Carelli" and insert the word --Carrelli-- therefor; and please delete "S.A." and insert --S.p.A.-- therefor.

Signed and Sealed this

Second Day of November, 1999

*Attest:*

Q. TODD DICKINSON

*Attesting Officer*

*Acting Commissioner of Patents and Trademarks*